United States Patent [19]

Upchurch

[11] 4,320,800

[45] Mar. 23, 1982

[54] INFLATABLE PACKER DRILL STEM TESTING SYSTEM

[75] Inventor: James M. Upchurch, Sugar Land, Tex.

[73] Assignee: Schlumberger Technology Corporation, New York, N.Y.

[21] Appl. No.: 103,660

[22] Filed: Dec. 14, 1979

[51] Int. Cl.[3] ..... E21B 43/00; E21B 33/127

[52] U.S. Cl. ..... 166/106; 166/187

[58] Field of Search ..... 166/187, 68, 106; 417/58, 214, 471

[56] References Cited

U.S. PATENT DOCUMENTS

| | | | |
|---|---|---|---|
| 2,863,511 | 12/1958 | Moosman | 166/205 |
| 3,308,887 | 3/1967 | Nutter | 166/150 |
| 3,439,740 | 4/1969 | Conouer | 166/250 |
| 3,712,758 | 1/1973 | Lech et al. | 417/214 |
| 3,876,000 | 4/1975 | Nutter | 166/187 |
| 3,876,003 | 4/1975 | Kisling | 166/191 |
| 3,926,254 | 12/1975 | Evans | 166/106 |

*Primary Examiner*—James A. Leppink

[57] ABSTRACT

In accordance with an illustrative embodiment of the present invention, a drill stem testing apparatus that utilizes upper and lower inflatable packer elements to isolate an interval of the borehole includes a unique pump system that is adapted to supply fluids under pressure to the respective elements in response to manipulation of the pipe string extending to the surface. The pump system includes a first pump assembly that is operated in response to rotation of the pipe string for inflating the lower packer element, and a functionally separate second pump assembly that is operated in response to vertical movement of the pipe string for inflating the upper packer element. The rotationally operated pump assembly is uniquely designed to limit the inflation pressure that is supplied to the lower packer, whereas the inflation pressure generated by the vertically operated pump can be monitored at the surface.

20 Claims, 22 Drawing Figures

INFLATABLE PACKER DRILL STEM TESTING SYSTEM

FIELD OF THE INVENTION

This invention relates in general to drill stem testing, and particularly to new and improved drill stem testing apparatus including a packer assembly that incorporates spaced apart inflatable elements arranged for sequential expansion in response to operation of functionally separate downhole pump assemblies in order to isolate an interval of the well bore undergoing test.

BACKGROUND OF THE INVENTION

One typical testing system that utilizes inflatable packer elements is disclosed, for example, in U.S. Pat. No. 3,439,740, issued to G. E. Conover. Both of the inflatable elements are expanded by a downhole pump that is actuated by rotation of the pipe string that extends from the tools to the surface. Such rotation causes a transversely oriented cam system to reciprocate a plurality of pistons or plungers which alternately draw in well bore fluids and supply them under pressure to the inflatable packing elements through fluid passages controlled by check valves. When a predetermined inflation pressure has been developed within the elements, a relief valve opens so that fluids are vented to the well annulus to prevent the development of excessive pressures. When it is desired to deflate the packing elements, further rotation is utilized to actuate an unloader valve and thereby bleed off the inflation pressure.

Another drill stem testing system of the type described is disclosed in U.S. Pat. Nos. 3,876,003 and 3,876,000 which are assigned to the assignee of this invention and which are incorporated herein by reference. This system employes vertically spaced inflatable packer elements that are inflated through the action of a downhole pump that is operated in response to upward and downward movement of the pipe string. Although this system and the device described in the U.S. Pat. No. 3,439,740 have been widely used, both systems have a number of disadvantages. Where both packer elements are inflated by a single downhole pump, it is not possible for the operator at the surface to be absolutely sure that the lower one of the inflatable elements has obtained a reliable packer seat that will not leak during the performance of a drill stem test, because the actual condition of the lower packer, as to whether it is anchored and fully packed off, is masked to some extent by the upper packer. Also, in both the prior systems the respective packer elements are connected to the pump by common inflation passages that have in part taken the form of a "wash pipe" extending from the upper packer to the lower packer inside of a lengthly spacer pipe. Of necessity, the spacer and wash pipes are assembled in fairly short sections in a concentric configuration which has caused considerable difficulties in field assembly of the string of testing tools.

It is one object of the present invention to provide new and improved drill stem testing tools that utilize inflatable packer elements to isolate the well interval to be tested.

Another object of the present invention is to provide a new and improved inflatable packer testing system that includes functionally separate pumps for inflating the respective packer elements to enable a sequential expansion of the elements under full surface control of the operator.

Yet another object of the present invention is to provide a new and improved inflatable packer system that through use of separate pumps to inflate the lower and upper elements eliminates the previous requirement of an internal conduit connections between the upper and lower elements.

Still another object of the present invention is to provide a new and improved rotationally operable pump system that includes a unique mechanism for limiting the inflation pressure that can be supplied by the pump to an inflatable packer element in a well.

SUMMARY OF THE INVENTION

These and other objects are attained in accordance with the concepts of the present invention through the provision of drill stem testing apparatus including packer means having spaced-apart elements arranged to be inflated and expanded into sealing contact with the surrounding well bore wall by fluid under pressure supplied to the respective interiors thereof. The lower packer element is inflated by a first pump assembly located in the tool string between the elements that is operated in response to rotation of the pipe string at the surface. This unique arrangements allows the lower packer element to be inflated first while the upper element remains retracted, and the operator can determine the set condition of the lower element by pulling on the pipe string at the surface. Once the lower element is set to seal off the lower end of the formation interval to be tested, a second pump assembly located in the tool string above the upper packer element is operated in response to reciprocating or upward and downward movement of the pipe string at the surface to cause inflation of the upper packer element. The second pump assembly is arranged so that a surface indication is given that the upper element is fully inflated, after which the main test valve included in the tool string can be actuated to flow and shut-in the isolated formation interval. Since the pump assemblies are separate and used to inflate respective packer elements, a connecting conduit extending between the elements is not required, which greatly simplifies the assembly of the tool string components prior to running the same into a well.

In accordance with a further aspect of the present invention, the first pump assembly that is used to inflate the lower packer element is uniquely arranged to provide a preselected maximum inflation pressure that is within the design limits of the packer. The rotary motion of the pipe string is converted to reciprocating motion of a pump piston through a linkage that includes a lost-motion connection normally held against relative movement by a preloaded spring that reacts with known pressure. When the inflation pressure developed in the pump chamber exceeds the spring pressure, the spring will compress and enable the lost-motion connection to operate to prevent transmission of longitudinal motion to the pump piston, so that there is a maximum value of pressure that is applied to the inflable packer element even though the operator continues to rotate the pipe string at the surface.

BRIEF DESCRIPTION OF THE DRAWINGS

The present invention has many other objects, features and advantages that will become more clearly apparent in connection with the following detailed description of a preferred embodiment, taken in conjunction with the appended drawings in which.

DESCRIPTION OF A PREFERRED EMBODIMENT

Figure 1A:
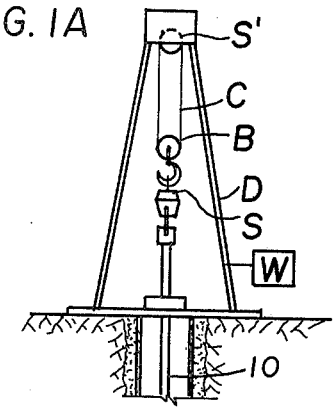
FIGS. 1A and 1B are schematic views of the string of drill stem testing tool utilizing inflatable packers suspended in a well bore.
Figure 1A:
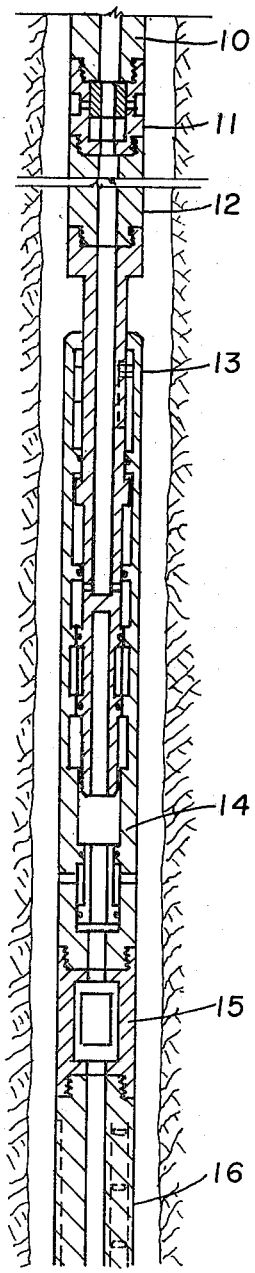
Figure 1B:
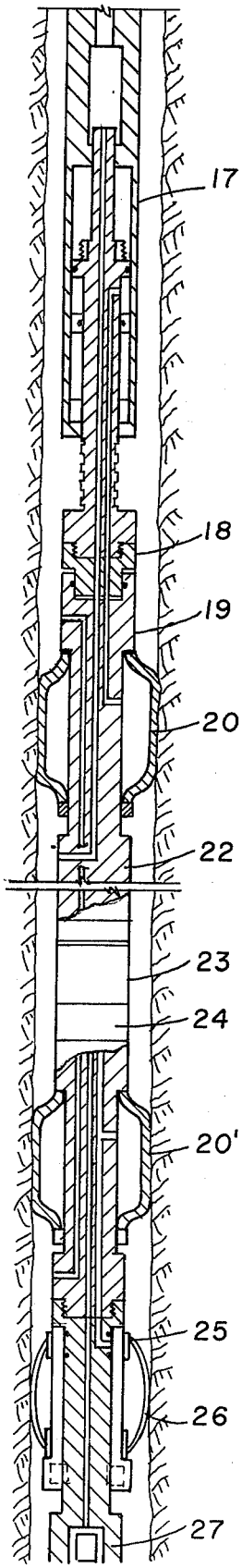

Referring initially to FIGS. 1A and 1B for a schematic illustration of the entire string of drill stem testing tools disposed in the borehole in position for conducting a test of an interval of the well, the running-in string 10 of drill pipe or tubing is provided with a reverse circulating valve 11 of any typical design, for example a valve of the type shown in U.S. Pat. No. 2,863,511, assigned to the assignee of this invention. A suitable length of drill pipe 12 is connected between the reverse circulating valve 11 and a multi-flow evaluator or test valve assembly 13 that functions to alternately flow and shut-in the formation interval to be tested. A preferred form of test valve assembly 13 is shown in U.S. Pat. No. 3,308,887, issued to Benjamin P. Nutter and also assigned to the assignee of this invention. The lower end of the test valve 13 is connected to a pressure relief valve 14 that is, in turn, connected to a recorder carrier 15 that houses a pressure recorder of the type shown in the assignee's U.S. Pat. No. 2,816,440. Of course the recorder functions to make a permanent record of fluid pressure versus lapsed time during the test in a typical manner. The recorder carrier 15 is connected to the upper end of a screen sub 16 that serves to take in and to exhaust well fluids during operation of an upper packer inflation pump assembly 17 to which the lower end of the screen sub is connected. The pump assembly 17, which together with the various other component parts of the tool string, will be described in considerably greater detail below, includes inner and outer telescoping members and a system of check valves arranged so that well fluids are displaced under pressure during upward movement of the outer member with respect to the inner member, and are drawn in via the screen sub 16 during downward movement. Thus a series of vertical upward and downward movements of the running-in string 10 is effective to operate the pump assembly 17 and to supply pressurized fluids for inflating the upper packer to be described below.

The lower end of the pump assembly 17 is coupled to an equalizing and packer deflating valve 18 that can be operated upon completion of the test to equalize the pressures in the well interval being tested with the hydrostatic head of the well fluids in the annulus above the tools, and to enable deflating the upper packer element to its normally relaxed condition. Of course an equalizing valve is necessary to enable the packers to be released so that the tool string can be withdrawn from the well. The valve 18 is connected to the upper end of a straddle-type inflatable packer system shown generally at 19, the system including upper and lower inflatable packers 20 and 20' connected together by various components including elongated spacer sub 22. The inflatable packers 20 and 20' each include an elastomeric sleeve that is normally retracted but which can be expanded outwardly by internal fluid pressure into sealing contact with the surrounding well bore wall. The length of the spacer sub 22 is selected such that during a test the upper packer 20 is above the upper end of the formation interval of interest, and the lower packer 20' is below the interval. Of course when the packer elements are expanded as shown in FIG. 1A, the well interval between the elements is isolated or sealed off from the rest of the well bore so that fluid recovery from the interval can be conducted through the tools described above and into the drill pipe 12.

A rotationally operated pump assembly 23 that is functionally separate from the upper pump assembly 17 is connected between the two packers and adapted to supply fluid under pressure to the lower packer 20' for inflating the same into sealing engagement with the well bore wall in response to rotation of the pipe string 10 extending upwardly to the surface. The pump 23 has its lower end connected to an intermediate packer deflating valve 24 that functions when operated at the end of a test to cause the packer 20' to deflate. The lower packer assembly 20' is generally similar in construction to the upper assembly 20, and has its lower end connected to a deflate-drag spring tool 25 having means 26 frictionally engaging the well bore wall in a manner to prevent rotation so as to enable rotary operation of the pump assembly 23. The tool 25 may also include a valve that is opened at termination of a test to insure deflation of the element 20'.

If desired, another recorder carrier 27 can be connected to the lower end of the drag tool 25 and arranged via an appropriate passageway to measure directly the formation fluid pressure in the isolated interval to enable a determination by comparison with the pressure readings of the recorder in the upper carrier 15 whether the test passages and ports have become blocked by debris or the like during the test. Also, though not shown in FIG. 1, it will be appreciated that other tools such as a jar and a safety joint may be incorporated in the string, for example between the test valve assembly 13 and the pump assembly 17, in accordance with typical practice.

As shown rather schematically in FIG. 1A, the pipe string 10 extends upwardly to the surface where it is suspended for handling within a derrick D by typical structure such as a swivel S, traveling block B and cable C extending between the traveling block and the crown block S' at the top of the derrick. The dead line of the cable has a transducer such as a load cell thereon to sense the weight of the drill string and the tools in the borehole. The output of the transducer is coupled to a weight indicator W that provides the rig operator with a visual indication of the precise amount of weight being supported by the cable and the derrick at all times. Of course the line end of the cable extends to a drawworks that is used in typical manner to raise and lower the pipe as desired.

Figure 7A:
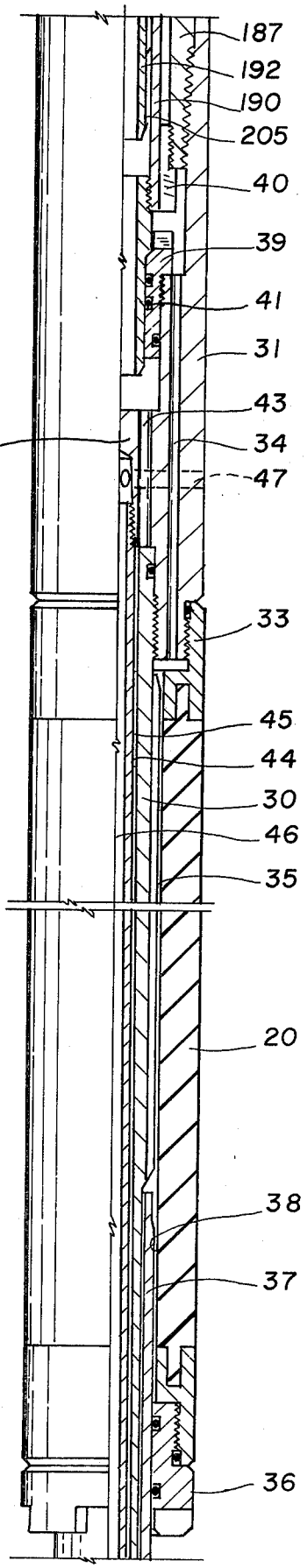
FIGS. 7A and 7B are cross-section views of the upper inflatable packer assembly coupled to the upper end of a spacer sub.

Turning now to a more detailed description of the various component parts of the string of drill stem testing tools, reference initially will be made to the upper inflatable packer assembly 19 shown in FIGS. 7A and 7B. The assembly includes a body member or mandrel 30 having its upper end fixed to an upper sub 31 and its lower end fixed to a lower sub 32. An inflatable packer element 20 surrounds the mandrel 30 and may be constituted by an elongated sleeve of elastomeric material such as neoprene that is internally reinforced by plies of woven metal braid or the like (not shown). The upper end of the element 20 is fixed to a collar 33 that is threaded to the upper sub 30, and may be retained with respect to the collar by means such as a frusto-conical ring that is forced against an inner surface of the element 20 by a lock nut or the like. Such structure is well known to those skilled in the art and need not be further elaborated here. One or more inflation ports or passages 34 extend vertically through the upper sub 31 and communicate with the annular space 35 between the inner wall surface of the sleeve 20 and the outer periphery of the mandrel 30. The lower end of the packer element 20 is also sealed and fixed with respect to an end cap 36 that is sealingly slidable along the mandrel 30, the lower portion of the mandrel being constituted by the combination with a passage sleeve 37 fitted around the mandrel 30 and laterally spaced therefrom to provide a continuation 38 of the passage space for inflation fluids. The upper sub 31 has a hollow seal sleeve 39 threadedly fixed therein and adapted to receive the lower end of an elongated flow tube 40 that extends upwardly within the equalizing and packer deflating valve assembly 18. The seal sleeve 39 carries seal rings 41 and is located in spaced relation above a transverse solid section 42 of the sub 31 which has, in addition to the inflation ports 34, a plurality of test ports 43 extending vertically therethrough. The ports 43 communicate with an annular fluid passage space 44 that is within the packer mandrel 30 but outside of a hollow flow tube 45 extending concentrically within the bore of the mandrel. The upper end of the flow tube 45 is threaded into the transverse section 42, and the bore 46 of the flow tube is opened to the well annulus outside the upper sub 31 by one or more laterally directed equalizing ports 47 that are angularly spaced in a transverse plane with respect to both the inflation ports 34 and the test ports 43.

Figure 7B:
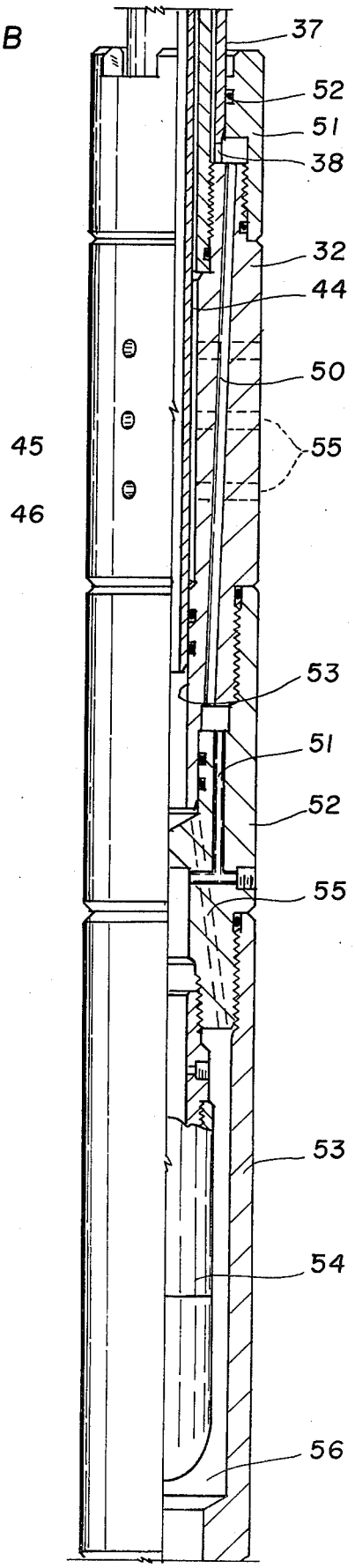

The lower sub 32 as shown in FIG. 7B is threaded to the lower end of the packer mandrel 30 and may have vertically extending passages 50 whose upper ends are placed in communication with the annular sleeve passage 38 by a collar 51 that is threaded to the sub 32 and sealed with respect to the sleeve 37 by an O-ring 52. The flow tube 45 has its lower end received within a seal bore 53 of the lower sub 32. The annular fluid passage space 44 between the tube 45 and the mandrel 30 is communicated with the well annulus by a plurality of laterally directed test ports 55 to enable formation fluids recovered during a test to enter the passage space 44 and pass upwardly through the tools. The passages 50 are communicated with ports 51 in a crossover sub 52 and lead to a recorder carrier 53 in which is mounted a pressure recorder 54 to enable the recorder to monitor inflation pressures applied to the packer element 20 by the upper pump 17. A plurality of holes 55 drilled in the sub 52 communicate the bore 46 of the tube 45 with the bore 56 of the recorder carrier 53 to provide together with the ports 47 the upper region of a straddle bypass as will be familiar to those skilled with the art.

Figure 5A:
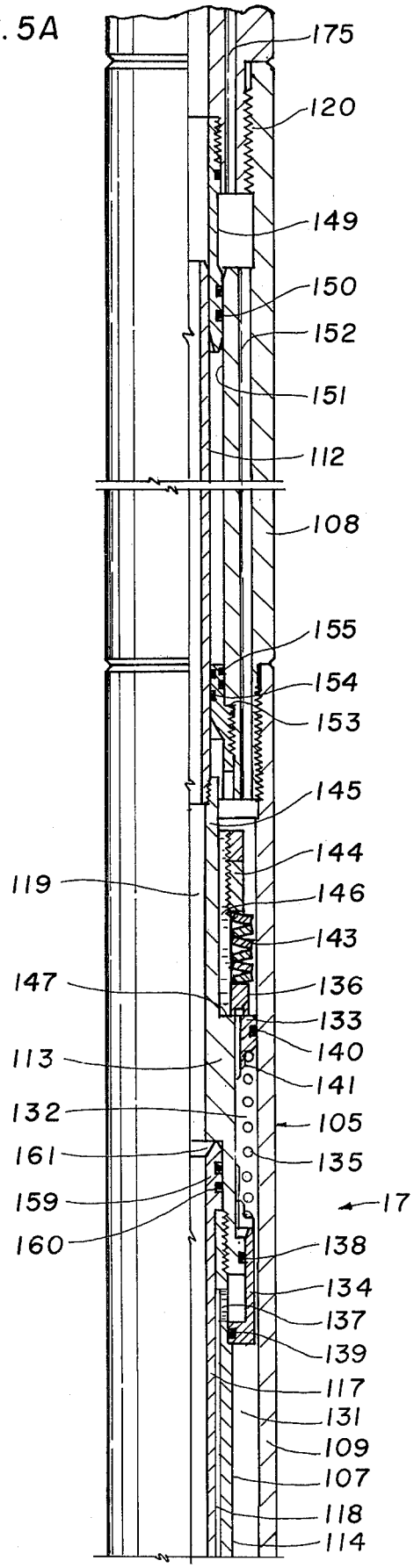
FIGS. 5A and 5B are longitudinal sectional views, with portions in side elevation, of the pump assembly that is operated by vertical pipe motion to inflate the upper packing element.
Figure 5B:
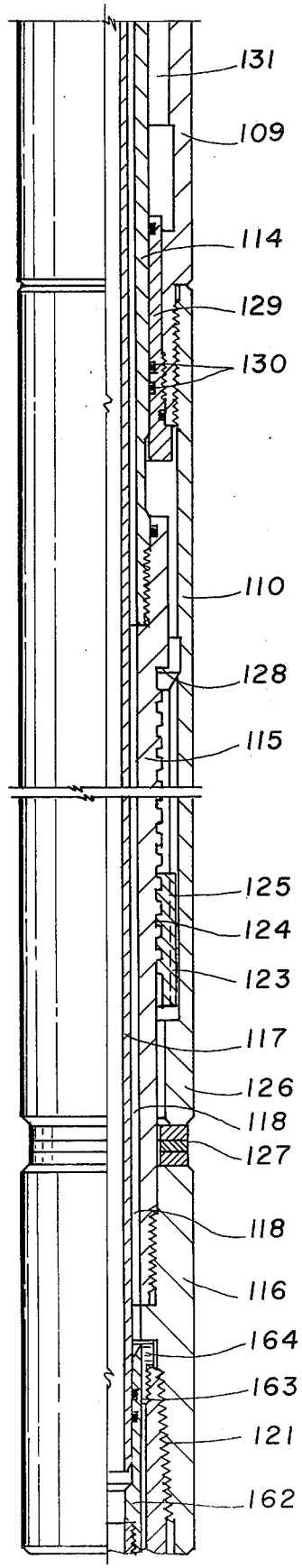

Turning now to FIGS. 5A and 5B, a preferred embodiment of a pump assembly 17 that can be operated by manipulation of the pipe string 10 to cause expansion of the upper packer element 20 is shown in greater detail. The pump 17 which is disclosed and claimed in the aforementioned U.S. Pat. No. 3,876,000, includes a housing 105 that extends downwardly in telescoping relation over a mandrel assembly 107 and is arranged for reciprocating motion with respect thereto between spaced longitudinal positions. The housing 105 is constituted by a series of threadedly interconnected tubular members including an upper sub 108, a cylinder section 109 and a splined section 110. The mandrel assembly 107 also comprises a number of interconnected, separate members including a flow tube 112, a valve section 113, a cylinder section 114 and a jack thread section 115 which has a pipe joint or collar 116 threaded on its lower end. Additionally, an elongated tube 117 is fixed concentrically within the members 114 and 115 and has its outer surface laterally spaced with respect thereto to provide an annular inflation fluid passage 118. The through bores of tube 117 and the mandrel sections 113 and 112 provide a central opening 119 for the passage of formation fluids through the pump assembly 17 from one end to the other. The upper sub 108 has an internal thread 120 for connection with the screen assembly 116 immediately thereabove, whereas the collar 116 has a similar thread 121 to adapt it for connection to the packer deflate and equalizing valve 18 located below the pump assembly 17.

Normally, that is when the tools are being lowered into the borehole, the housing 105 is locked in a lower position with respect to the mandrel assembly 107 by a clutch nut 123 (FIG. 5B) that is threaded at 124 to the mandrel section 115 and has a slidable spline connection 125 to the housing section 110. The clutch nut 123 engages above an inwardly extending shoulder 126 at the lower end of the housing section 110 to prevent upward movement, and several stacked thrust washers or bearings 127 can be located between the shoulder 126 and the upper face of the collar 116 to enable rotation with relative ease. Rotation of the housing 105 with respect to the mandrel assembly 107 will cause the clutch nut 123 to feed upwardly until it comes into contact with a shoulder 128 on the mandrel, in which position the housing 105 is free to be moved upwardly and downwardly within limits along the mandrel assembly 107 in response to vertical motion of the pipe string 10 at the surface.

Figure 10A:
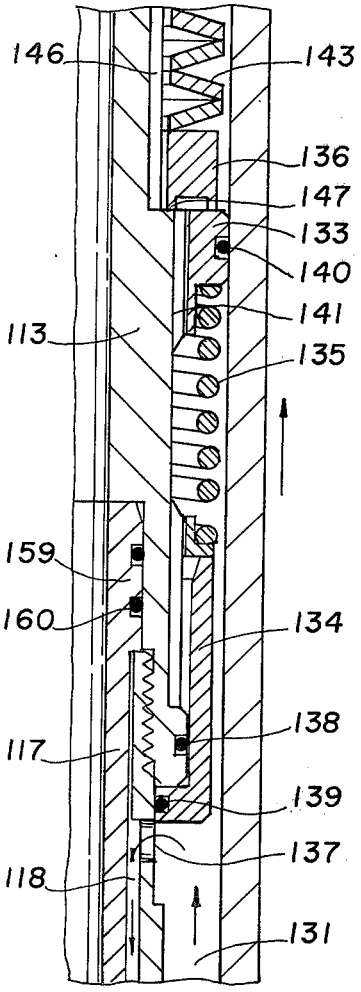
FIGS. 10A–10C are fragmentary sectional views showing the various operating positions of the valve assemblies that control the intake and supply of pressurized fluid to and from the upper pump assembly.
Figure 10B:
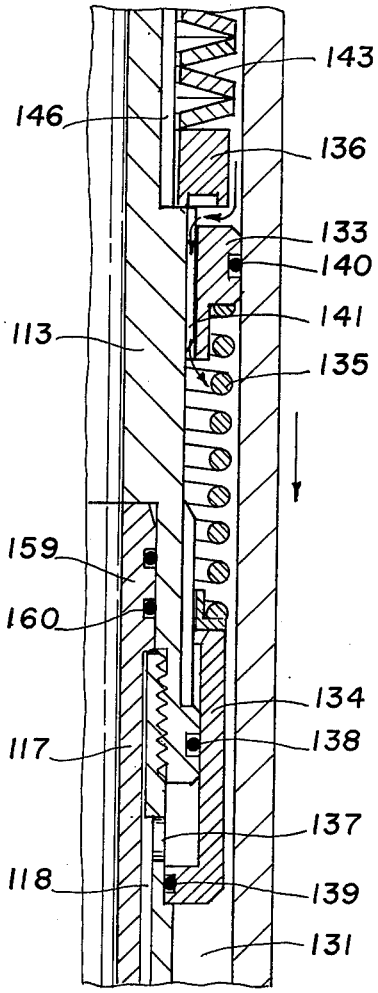

The lower end of housing cylinder section 109 is provided with a sleeve piston 129 that is sealed with respect to the mandrel cylinder section 114 by seal rings 130. The annular cavity 131 location above the sleeve piston 129 provides the working volume of the pump. The upper end of the cylinder space 131 is defined by a check valve system indicated generally at 132 which includes a fluid intake valve 133 and an exhaust valve 134. The intake valve 133 comprises an annular member that is pressed upwardly by a coil spring 135 against a valve seat ring 136, whereas the exhaust valve 134 is constituted by a stepped diameter sleeve that is pressed downwardly by the coil spring 135 in a lower position where it spans one or more fluid exhaust ports 137 that lead to the annular inflation passage 118 located between the hollow tube 117 and the inner surface of the mandrel cylinder section 114. Inasmuch as the valve sleeve 134 has a resultant transverse pressure area defined by the difference between the seal areas of the rings 138 and 139, it will be appreciated that a greater fluid pressure generated in the cylinder space 131 during upward movement of the housing 105 relative to the mandrel assembly 107 will shift the valve sleeve upwardly against the bias afforded by the coil spring 135 to a position uncovering the exhaust ports 137, as shown in greater detail in FIG. 10A, so that fluids under pressure can be supplied to the passage 118. On the other hand, during downward relative movement the spring 135 pushes the valve sleeve 134 closed, and a reduction in cylinder pressure below hydrostatic fluid pressure will cause the intake valve 133 to move away from the seat ring 136 as shown in FIG. 10B, thereby admitting well fluids into the cylinder space 131 and allowing it to fill during such downward relative movement. When the housing 105 reaches the bottom of its stroke, the spring 135 will push the intake valve 133 upwardly to closed position so that the pumping cycle can be repeated. As shown in FIG. 5A, the intake valve 133 carries a seal ring 140 that seals against the inner wall surface of the housing section 109, and is slidably arranged around a thickened wall portion of the mandrel section 113 which is longitudinally grooved at 141 to provide for fluid enty past the valve. The valve seat ring 139 may be provided with spaced apart, annular projections on its lower face that straddle the grooves 141 to provide a fluid tight interfit in the closed position of the valve, the inner projection resting on a mandrel shoulder 147 and the outer projection abutting the top surface of the valve element 133.

Figure 10C:
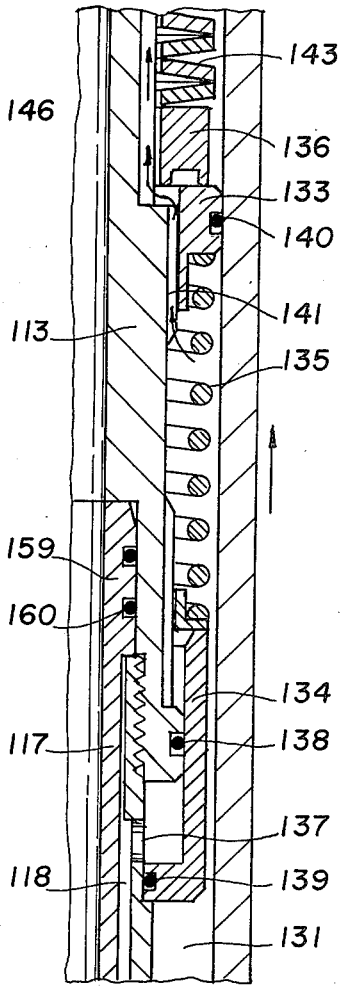

It should be noted at this point that the valve seat ring 136 is vertically movable to some extent, but normally is held in its lower position by a yieldable structure 143 that may comprise, for example, a series of Bellville washers located below an adjustable retaining nut 144 threaded on the mandrel section 113. The nut 144 and the washers 143 are located on a reduced diameter portion 145 of the mandrel section, the portion 145 having circumferentially spaced, longitudinally extending grooves 146 that provide for the passage of fluids internally of the nuts 144 and the washers 143. Thus it will be recognized that when the pressure generated in the cylinder space 131 reaches a certain predetermined maximum value, the seat ring 136 can be forced upwardly together with the valve element 133 to disengage the inner projection from the shoulder surface 147 as shown in FIG. 10C to allow pressurized fluids in the cylinder space 131 to vent out via the grooves 146. This system dictates a maximum value of inflation pressure that can be supplied by the pump assembly 17 to the upper inflatable packer element 20, which value is sufficient to fully expand it against the well bore wall while providing a protection against excessive inflation pressures that might otherwise result in damage. The magnitude of the pressure at which the seat ring 136 will move upwardly is set at a preselected value by adjustment of the preload in the washer springs 143 through appropriate vertical adjustment of the retainer nut 144.

The upper sub 108 of the housing assembly 105 provides fluids passages to the check valve system 132 and is, as previously mentioned, connected to the lower end of the screen assembly 16. As shown in FIG. 5A, a seal nipple 149 on the lower end of the screen assembly is sized to fit over the upper end of the tube 112 and carries seal rings 150 that engage the internal wall surface 151 of the sub 108. A plurality of vertically extending ports 152 serve to conduct fluids from the screen assembly 16 through the wall of the sub 108 and into the region above the check valve assembly 132. The lower portion of the sub 108 carries a seal sleeve 153 with a through bore that receives the tube 112. Seal rings 154 and 155 prevent fluid leakage between the ports 152 and the bore of the tube 112 during longitudinal relative movement. The seal rings 154 engage on a smaller diameter than do the seal rings 130 on the piston 129, so that during upward movement of the housing 105 relative to the mandrel assembly 107, a greater volume of well fluids will be brought into the pump assembly 17 than is required to fill the working volume of the pump during the next or subsequent downward movement. Thus, during each downward movement, not only is fluid supplied to fill the chamber 131, but also a certain amount of the fluids is forced back upwardly into the screen assembly 16 via the ports 152 to provide a backflushing action to ensure that the screen assembly, to be described in detail herebelow, cannot become clogged by debris or other foreign matter in the well fluids.

The upper end of the lower tube 117 is provided with an enlarged head 159 that carries seal rings 160 and is interfitted between a shoulder 161 on the mandrel section 113 and the upper end face of the mandrel section 114. The lowermost end of the tube 117 is received by a flow coupling 162 (FIG. 5B) having seals 163 to prevent fluid leakage. The flow coupling 162 has an outwardly directed flange 164 at its upper end that is longitudinally grooved to provide for the flow of inflation fluids from the passage 118 into the annular area between the coupling and the body of the packer deflate and equalizing valve 18 connected immediately below the pump assembly 19.

Figure 4A:
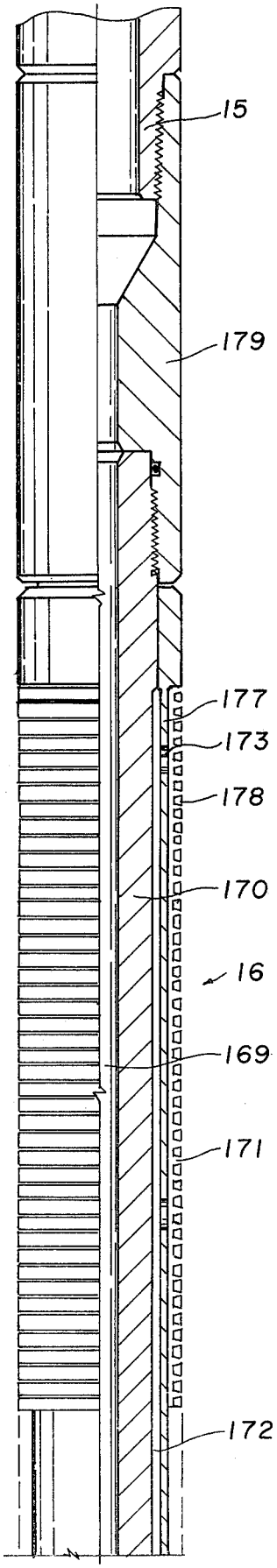
FIGS. 4A and 4B are sectional views similar to FIG. 2 of the screened fluid intake for the upper packer inflating pump.
Figure 4B:
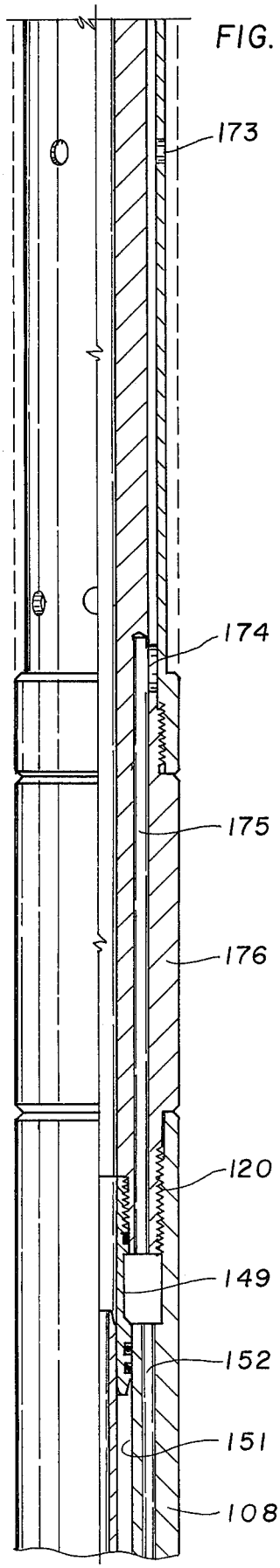

The well fluids coming into the pump assembly 17 pass through the screen sub assembly 16 shown in FIGS. 4A and 4B, wherein inner and outer members 170 and 171 are rigidly fixed and laterally spaced to provide an annular passage space 172 that is placed in communication with the well bore by a plurality of ports 173. The lower end of the passage space 172 is joined by a port 174 to a vertically disposed bore 175 that extends downwardly within the wall section of a connecting sub 176 to communicate the fluids to the interior of pump assembly 17. The seal nipple 149 is threaded to the lower end of the connecting sub 176 and sealingly interfits with the inner wall 151 of the upper sub 108 of the pump assembly 17 as previously described. The outer member 171 is provided with an external recess throughout a major portion of its length, and a screen element 178, formed of flat, spiral-wound wire or other suitable material, is positioned in the recess 177. The element 178 acts as a filter to prevent rock chips or other debris in the well fluids from coming into the pump assembly 17. A tool joint or collar 179 couples the upper end of the screen assembly 16 to the pressure recorder carrier 15 located immediately thereabove. The throughbore 169 of the member 170 continues the passage for the flow of formation fluids upwardly through the tools.

Figure 6A:
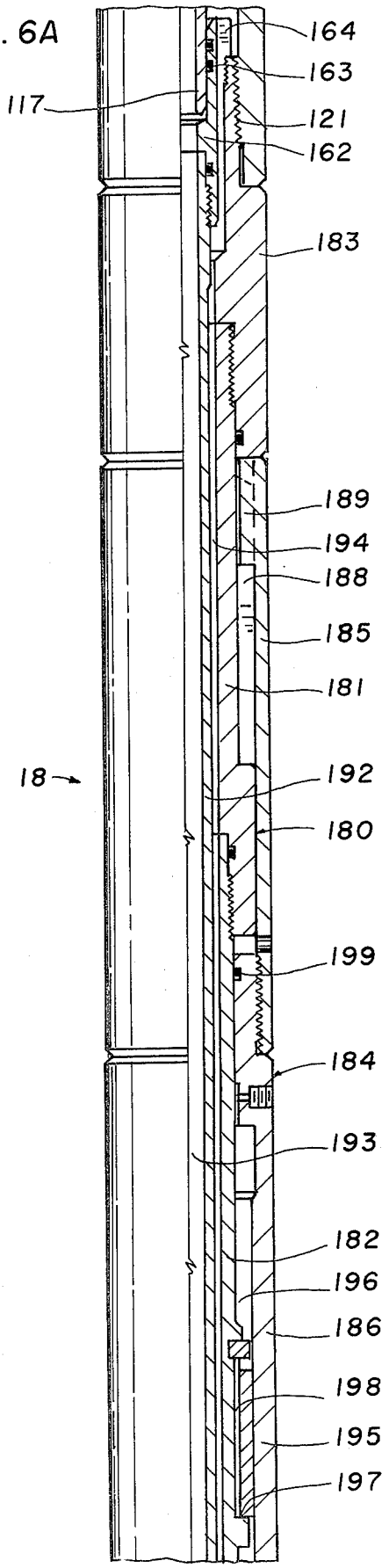
FIGS. 6A and 6B are cross-section views of the pressure equalizing and upper packer deflating valve assembly.
Figure 6B:
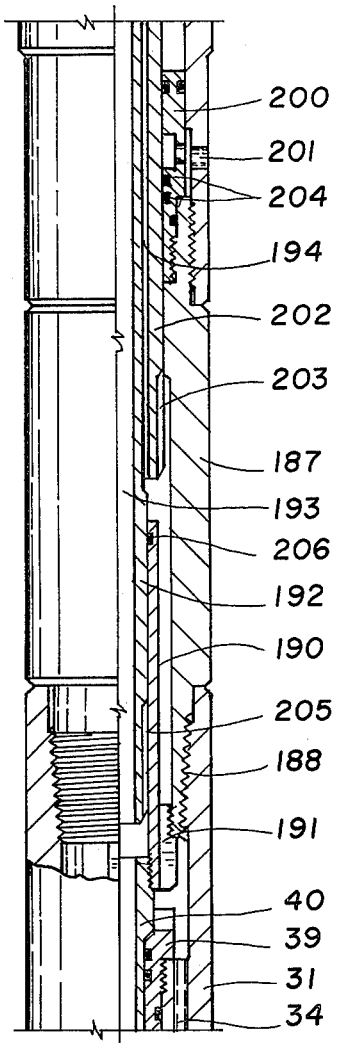

Turning now to the structural details of the pressure equalizing and packer deflating valve assembly 18 shown in FIGS. 6A and 6B, which assembly functions to enable the pressure of fluids in the isolated formation interval to equalize with the hydrostatic head of fluid immediately above the upper packer 20 upon completion of the test, as well as enabling the upper packer element 20 to be deflated, the assembly comprises a mandrel 180 having an upper section 181 and a lower section 182, the upper section being provided with a collar 183 to adapt it for connection to the lower end of the pump assembly 17. The mandrel 180 is movable relatively within an outer member or housing 184 formed of threadedly interconnected sections 185, 186 and 187, the lower section or sub 187 being adapted by threads 188 for connection to the upper end of the packer assembly 19. The adjacent mandrel and housing sections 181 and 185 have interengaged splines 188 and 189 to prevent relative retation and to provide limits for longitudinal relative movement. A valve sleeve 190 is fixed by threads 191 to the lower end portion 187 of the housing 184 and extends upwardly therein, and an elongated flow tube 192 whose upper end is connected to the flow coupling 162 extends downwardly into the valve sleeve 190. The central bore 193 of the flow tube 192 provides an upward passage for formation fluids that are recovered during the test, whereas the outer periphery of the tube is spaced inwardly of the inner wall surface of the mandrel 180 to provide a continuing inflation passage 194 leading from the pump assembly 17 to the packer assembly 20. The telescoping joint comprising the members 180 and 184 can be readily closed by downward movement of the mandrel 180, however upward movement to open position is delayed for a significant time interval by a hydraulic system including a metering piston 195 disposed within a chamber 196 located interiorly of the housing section 186. The piston 195 is sized to provide for a restricted leakage of hydraulic fluid from above to below it during upward movement, however the piston can move away from an annular seat surface 197 during downward movement so that hydraulic fluid can pass freely through external grooves 198 in the mandrel section 182 behind the metering piston. The chamber 196 is closed at its upper end by a seal ring 199 and at its lower end by a floating balance piston 200 whose lower face is subject to the pressure of fluids in the well annulus via ports 201. The balance piston 200 functions to transmit the pressure of the well fluids to the hydraulic fluid below the metering piston 195 so that the pressure in this region of the chamber is never less than the hydrostatic fluid pressure in the well bore outside.

The lower end section 202 of the mandrel 180 is provided with external bypass grooves 203 that are arranged to communicate the inflation passage 194 with the well annulus via the ports 201 when the mandrel 180 is moved to its fully extended or open position with respect to the housing 184. Communication is by virtue of the fact that the upper ends of the grooves 203 will extend past the O-ring seals 204 to enable fluids to flow from the inflation passage 194 to the well annulus. Moreover the flow tube 192 is provided with similar grooves 205 that normally are positioned below a seal ring 206 on the valve sleeve 190. The upward movement that opens the inflation passage 194 to the well annulus also will position the upper ends of the grooves 205 above the seal ring 206 so that the formation fluid passage 193 is communicated with the well annulus. When this occurs, the inflation pressure within the upper packer element 20 and the pressure in the well bore interval between the packers 20 and 20' are equalized with hydrostatic pressure in the well to enable the upper packer to deflate and return to its normal, relaxed position.

Figure 9A:
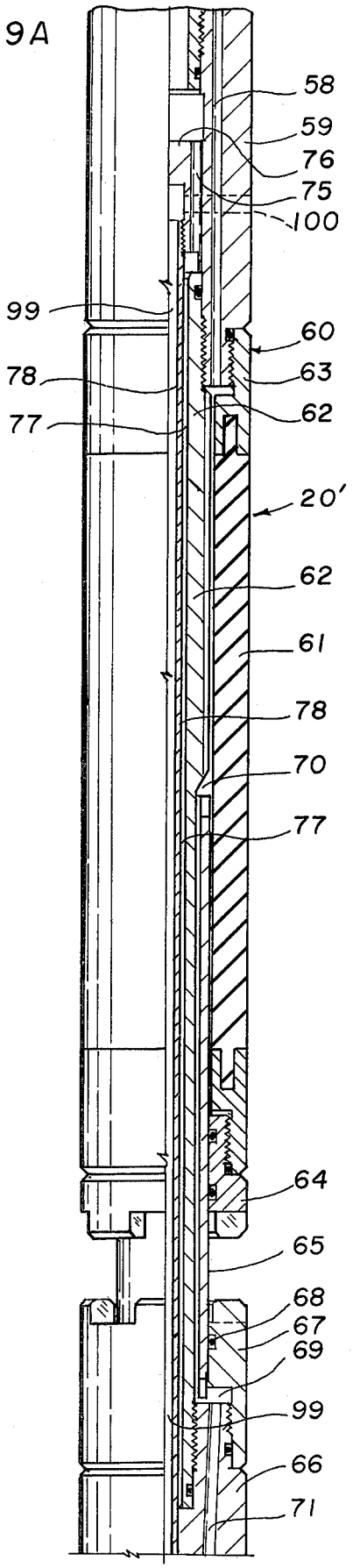
FIGS. 9A–9C are longitudinal sectional views of the lower inflatable packing element, a drag spring-deflate tool and a pressure recorder carrier, respectively.

Turning now to the details of the lower inflatable packer assembly 20' which functions when inflated to seal off the lower end of the formation interval to be tested, the lower assembly is substantially similar to the upper assembly 20 in its arrangement of an inflatable elastomeric packer element 61 (FIG. 9A) that surrounds a mandrel 62 with the upper end of the element fixed to a collar 63 and the lower end fixed to a movable end cap 64 that is sealingly slidable on an outer sleeve 65 that surrounds the lower end portion of the mandrel. The lower end of the mandrel 62 is fixed to a lower sub 66, and a collar 67 carrying an O-ring seal 68 provides an internal recess 69 that communicates the inside 70 of the packer element 61 with one or more ports 71 that extend downwardly through the sub 66. The upper end of the mandrel 62 is threaded into an upper sub 59, to which the cap 63 also is attached, the sub 59 having vertically directed passages 75 and 58 with the passage 75 communicating with the annular space 77 between the mandrel 62 and an inner tube 78, and the passage 59 communicating with the inner region 70 of the packing element 61. The upper sub 59 is provided with a solid transverse section 76 that blocks the bore 77 of the tube 78 at its upper end, however the bore 77 is opened to the well annulus by one or more ports 100. The tube 78 extends downwardly throughout the length of the assembly 20' and has its lower end sealed against the inner wall of a seal mandrel 80 that is threaded to the lower end of the sub 66 and extends downwardly therefrom.

Figure 9B:
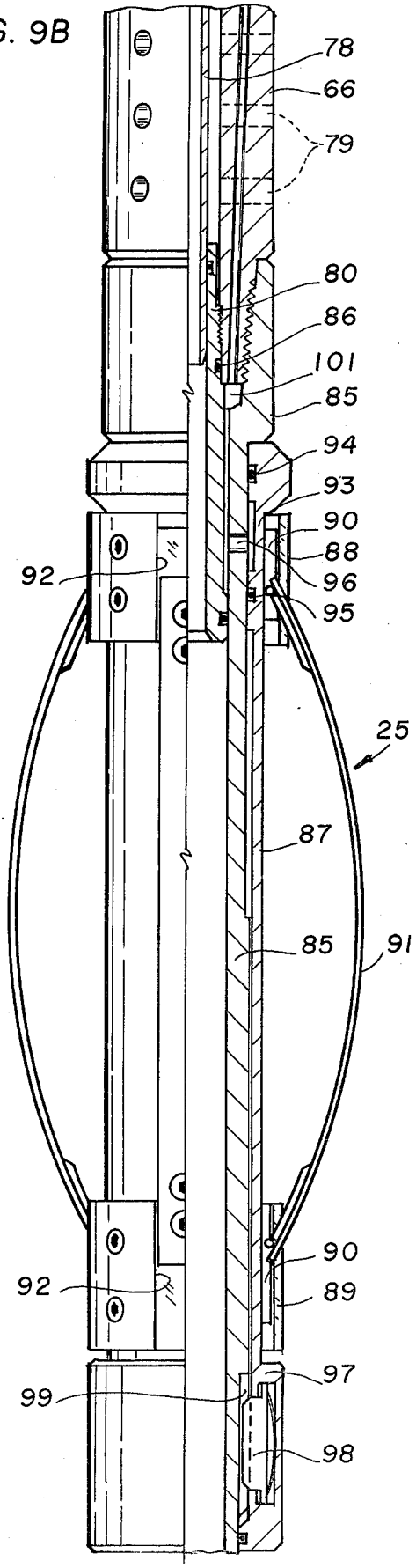

The deflate-drag spring tool 25 is connected to the lower sub 66 of the packer assembly 20' as shown in FIG. 9B and includes a tublar body 85 having its upper end connected to the sub by threads 86. A drag spring assembly is slidably carried on the body 85 and includes a carrier sleeve 87 having slotted collars 88 and 89 fixed near its ends. The collars receive the end fittings 90 of a plurality of circumferentially spaced, outwardly bowed "belly" springs 91 whose outer surfaces slidably engage the wall surface on the well bore in a manner to restrain or prevent relative rotation. The end fittings 90 are slidable longitudinally within the respective slots 92 to enable the springs to resile somewhat and accommodate different well bore diameters.

Figure 9C:
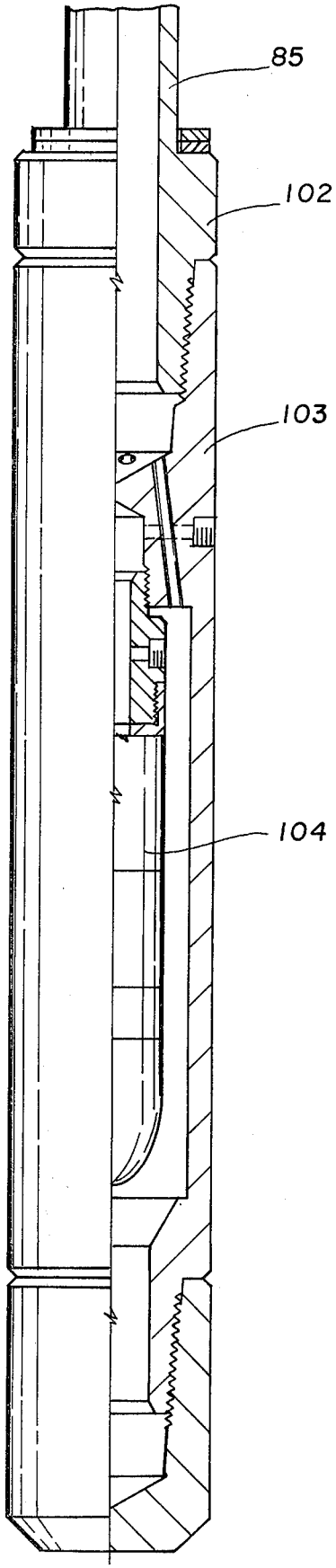

The upper section 93 of the carrier sleeve 87 constitutes a valve head having seal rings 94 and 95 normally engaged above and below lateral ports 96 in the body 85 to normally prevent loss of pressure therethrough. The seal mandrel 80 extends into the body 85 and carries a seal ring at its lower end that engages the inner wall of the body below the ports 96. The lower section 97 of the sleeve carries a plurality of inwardly based keys 98 that normally engage spline grooves 99 in the outer wall of the body in a manner to prevent relative rotation between the drag springs 91 and the body 85. However should the body 85 be moved upwardly relative to the drag springs 91 which are held fractionally in place through engagement with the well bore wall, the ports 96 will be exposed to the well annulus above the valve head 93 to communicate the space 101 and the ports 71 with the well annulus. Upward movement also will cause the keys 98 to disengage from the grooves 99 so that the drag springs 91 can rotate freely on the body 85. As shown in FIG 9C, the body 85 extends below the carrier sleeve 87 and has a flange 102 at its lower end to limit downward movement of the drag spring assembly.

A recorder carrier 104 having a typical pressure recorder 104 suitably mounted therein is connected to the lower end of the tool body 85. The recorder 104 is in communication with the test interval between the packer elements 20 and 20' via the respective bores of the tool body 85, the seal mandrel 80, the tube 78, and the lateral ports 100 in the upper sub 59 of the packer assembly 20. Thus the pressure recorder 104 "sees" the pressures of fluids in the isolated well annulus undergoing test, and provides a second pressure record that can be compared with the data gathered by the upper or "inside" recorder 15.

Figure 8A:
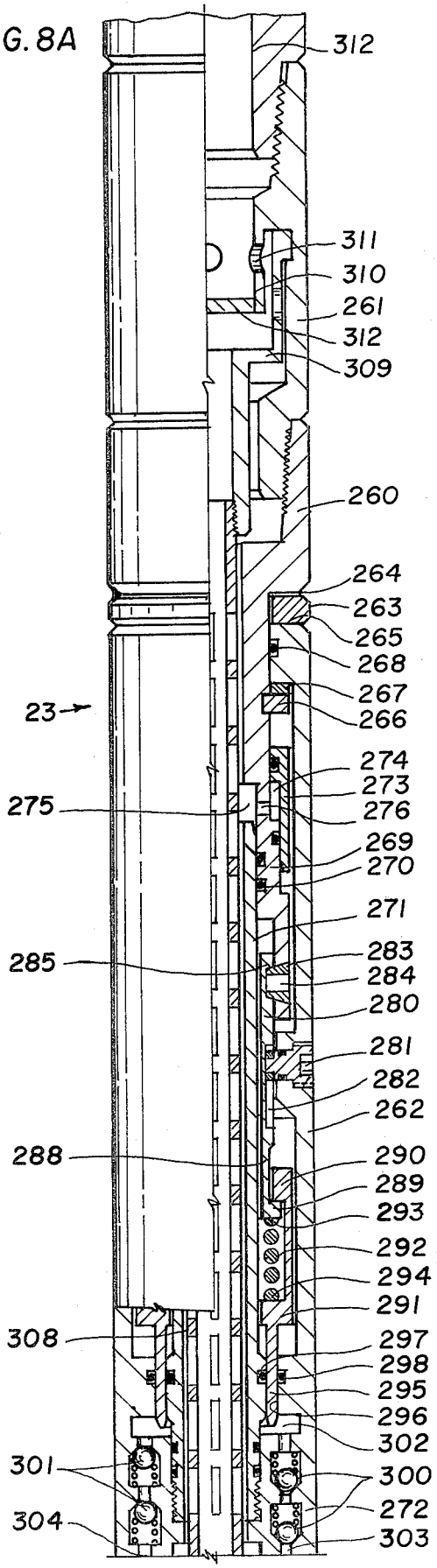
FIGS. 8A and 8B are longitudinal sectional views, with portions inside elevation, of the rotary pump assembly used to inflate the lower packing element, and a deflate-equalizing valve for such lower element.
Figure 8B:
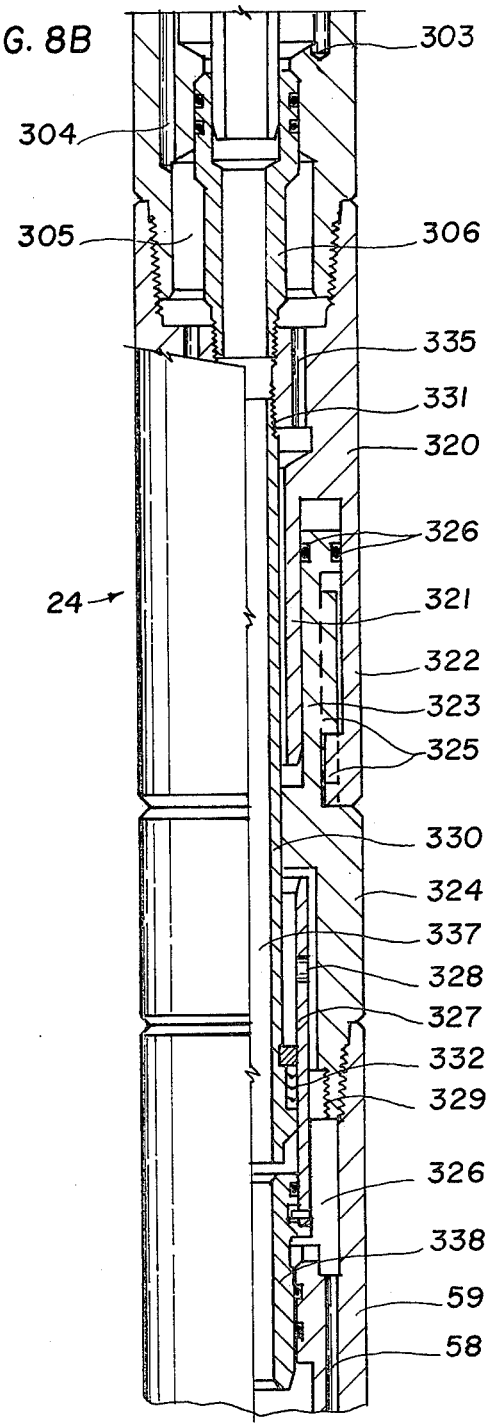

The lower pump 23 that is used to inflate the lower packing element 20' is shown in detail in FIGS. 8A and 8B. The pump 23 is operation by rotating the pipe string 10 and includes a mandrel 260 having its upper end threaded to the lower end of a screen sub 261 and its lower section extending down into the upper end of an elongated tubular housing 262. A bearing ring 263 is positioned between opposed shoulders 264 and 265 of the mandrel 260 and the housing 262, and a lock ring 266 and thrust washer 276 couple the parts together for relative rotation. A seal ring 28 prevents fluid leakage. A stepped diameter section 269 of the mandrel 260 is sealed by O-rings 270 with respect to a piston sleeve 271 that has its lower end threaded into an inwardly thickened section 272 of the housing 262 and carries a pressure compensating sleeve 273 that is movable within limits on the section 269 and defines therewith a variable capacity chamber 274 that is communicated with the inner bore 275 of the assembly by one or more ports 276.

Figure 8C:
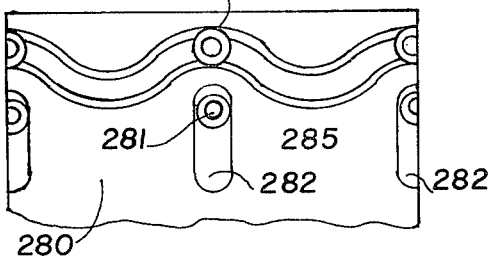
FIG. 8C is a developed plan view of a cam and follower arrangement used in the pump shown in FIG. 8A to convert rotary to reciprocating motion.

A cam sleeve 280 is mounted for reciprocating movement on the piston sleeve 271 and is slidably splined for axial movement relative to the housing 262 by suitable means such as diametrically opposed pins 281 threaded into the wall of the housing and having their inner ends received in slots 282 formed in the vertical direction in the outer wall on the cam sleeve 280. A pair of diametrically opposed cam rollers 283 are mounted on inwardly projecting pins 284 that are fixed near the bottom of the mandrel 260, the rollers being received in an endless, undulating annular groove 285 formed in the upper periphery of the cam sleeve 280, in a manner such that rotation of the mandrel 260 relative to the housing 262 causes the cam sleeve 280 to reciprocate vertically within the housing 262. The arrangement of the annular groove 285 and the vertical slots 282 and their relationship with respect to the pins 281 and cam rollers 283 are shown in plan view in FIG. 8C.

A connector sleeve 288 is fixed to the lower end of cam sleeve 280 and has an outwardly directed flange 289 at its lower end that fits underneath an inwardly directed shoulder 290 at the upper end of a piston member 291. A suitable spring means such as a coil compression spring 292 or a stack of Bellville washers reacts between the lower face 293 of the flange 289 and an upwardly facing shoulder 294 on the piston member 291. A sleeve 295 that forms the lower section of the piston member 291 extends into an annular space or cylinder 296 formed between an inner wall of the housing 262 and the adjacent outer wall of the piston sleeve 271 and is sealed with respect to the walls of the cylinder by seal rings 297 and 298.

Intake check valve assemblies 300 and exhaust check valve assemblies 301 are mounted in vertically extending bores formed in the thickened section 272 of the housing 262 and are typical one-way devices that control flow to and from the working chamber 302 during operation of the pump 23. It will be recognized that as the sleeve 295 moves upwardly the volume of the chamber 302 is increased, causing fluids from inside the assembly to flow into the chamber 302 via the passage 303 and the check valves 300 while the exhaust checks 301 remain seated and closed in the upward direction. Then as the sleeve 295 moves downwardly into the chamber 302, fluid is displaced therefrom through the exhaust passage 304 as the checks 301 open while the inlet checks 300 are seated and closed in the downward direction. The exhaust passage 304 opens into the annular space 305 outside a seal tube 306, which space is in communication with the interior of the lower inflatable packer element 20' as will be described in more detail herebelow. Fluids coming into the intake passage 303 of the pump are channeled from the inner bore of the assembly through an elongated screen tube 308 that extends throughout the length of the housing 262 and the mandrel 260. The screen tube 308 has a multiplicity of slots formed in it that are small to prevent particles of debris in the well from coming into the pump chamber.

It may be observed at this point that the maximum inflation pressure that the pump 23 can deliver to the packer element 20' is a function of the cross-sectional area of the sleeve 295 and the strength of the spring means 292 which is assembled into the pump in a preloaded condition. Thus so long as the inflation pressure generated in the chamber 302 is below a certain predetermined amount, the connector sleeve 288 and the piston member 291 will reciprocated together, with the driving force being transmitted through the preloaded spring 292. However, when the inflation pressure in the chamber 302 reaches a maximum value in excess of the hydrostatic pressure in the well, the preload of the spring 292 is exceeded whereby the spring is compressed during each downward movement of the connector sleeve 288 while the piston sleeve 291 remains stationary. Thus the maximum inflation pressure that the pump will deliver to the lower packer element 20' can be set within design limits prior to running the tool string into the well.

The screen sub 261 houses an adapter sleeve 309 to which the upper end of the screen tube 308 is threaded. The sub 261 may also include a downwardly extending sleeve 310 having side ports 311 above a transverse partition 312 to provide a region for settlement of debris in fluids flowing downwardly in the tool. The upper end of the sub 261 is attached to the lower end of a spacer pipe 312 that has its upper end connected to the recorder carrier 54 shown in FIGS. 7B. Of course the length of the spacer sub 312 is chosen to set the desired vertical spacing of the packing elements 20 and 20' depending upon the length of the well interval to be tested.

An intermediate deflate valve assembly 24 shown in FIG. 8B is connected between the lower end of the pump 23 and the upper end of the lower inflatable packer assembly 20'. This valve assembly includes an upper sub 320 having inner and outer sleeves 321 and 322 telescoped over the upper end section 323 of a tubular housing member 324. The section 323 and the sleeve 322 have meshed splines 325 and coengaged seals 326 to provide a sealingly slidable coupling. A valve sleeve 327 having one or more radial ports 328 through its wall is fixed to the housing member 324 by threads 329 have flow slots extending therepast as shown. An elongated hollow tube 330 has its upper end threaded to the upper sub 320 at 331, and the lower end of the tube carries a packing element 332 which sealingly engages the inner wall of the valve sleeve 327 below the ports 328 when the parts are in the retracted relative position shown in FIG. 8B. In such retracted position the continuity of the inflation passage extending from the pump 23 to the packer assembly 20, such passage including the space 305, ports 334, the annular clearance between the tube 330 and elements 321 and 324, the ports 328, the space 336 and the ports 58, is maintained. However, when the upper sub 320 is raised relative to the housing member 324, the packing 332 on the lower end of the tube 330 will be positioned above the ports 328 to communicate the inflation passage with the inner bore 337 of the assembly to enable deflation of the lower packing element 20' as will be discussed in more detail below. The lower end of the valve sleeve 327 is suitably attached to an adapter 338 which is sealed with respect to the upper head 59 of the packer assembly 20'.

Figure 2A:
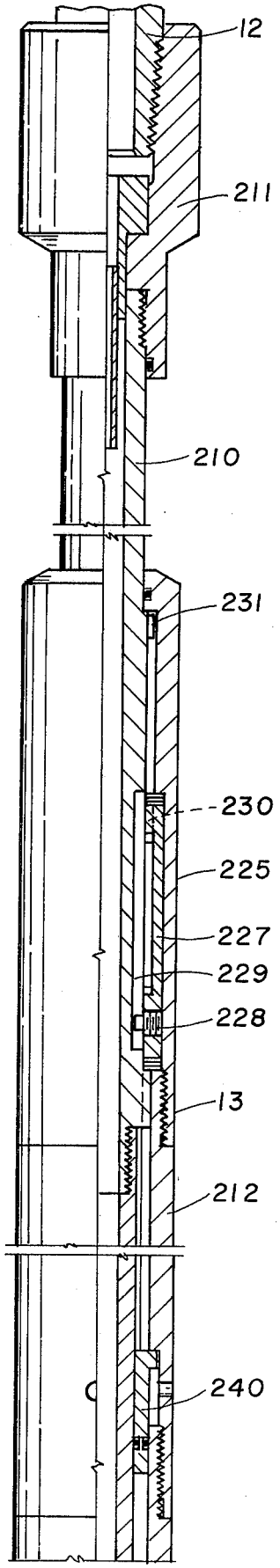
FIGS. 2A and 2B are detailed cross-sectional views, with portions in side elevation, of the formation test valve assembly, FIG. 2B forming a lower continuation of FIG. 2A.
Figure 2B:
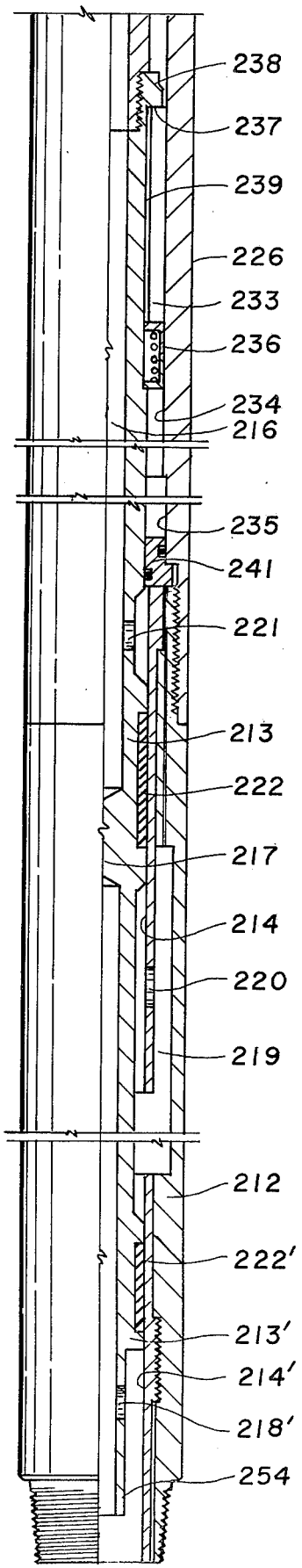

The details of the test valve assembly 13 that is utilized to flow and shut-in the formation once it has been isolated by the packer assembly 19 in response to actuation of the pump 17 are shown in detail in my U.S. Pat. No. 3,308,887, to which reference is made herein. For purposes of completeness of this disclosure however, the tester as shown in FIGS. 2A and 2B includes a mandrel 210 that is connected to the pipe string 12 by a coupling 211. The mandrel 210 is telescopically disposed within a housing 212 whose lower end is threadedly connected to the upper end of the pressure relief valve assembly 14. The mandrel 210 is movable between a upper or extended position and a lower or contracted position within the housing 212 for the purpose of actuating a test valve to open and close a flow path throught the tools. The valve assembly as shown in FIG. 2B comprises spaced upper and lower valve heads 213 and 213' that can simultaneously engage valve seats 214 and 214' in order to block fluid flow from within the housing below the lower valve head into the bore 216 above a transverse barrier 217 in the mandrel 210, and which are disengaged from the valve seats by downward movement in order to enable fluids to flow past the barrier via ports 218, an annular elongated sample chamber 219, and ports 220 and 221. Seals 222 and 222' prevent fluid leakage in the closed position. It should be noted that in the closed position, a sample of the fluids flowing upwardly through the tester will be trapped within the sample chamber 219 for recovery to the surface with the tools for later inspection and analysis.

In addition to the valve and sampler section described immediately above, the tester assembly 13 includes an index section 225 and a hydraulic delay section 226. The index section 225 comprises a sleeve 227 that is mounted for rotation relative to both the housing 212 and the mandrel 210 and which carries an index pin 228 that works in a channel system 229 formed in the outer periphery of the mandrel 210. The coaction of the index pin 228 with the channel system 229 as the mandrel 210 is moved vertically within the housing 212 causes the sleeve 227 to swivel between various angular dispostions in order to position one or more internal spline grooves 230 therein in such a manner that corresponding lugs 231 on the mandrel either can or can not pass therethrough. This the index system 225 functions basically to provide stops to downward movement of the mandrel 210 in certain positions thereof as will be further discussed herebelow. The delay section 226 (FIG. 2B) includes a metering piston 233 that is mounted on the mandrel 210 and is slidable within a stepped diameter cylinder 234 in the housing 212. The piston 233 is sized transversely in such a manner that hydraulic fluid in the cylinder 234 can leak or meter past the sleeve at a controlled rate during downward movement of the mandrel 210 until the sleeve enters the enlarged diameter portion 235 of the cylinder, whereupon the mandrel 210 can move quickly downwardly to its fully contracted position. The piston 233 is biased by a spring 236 upwardly against a seat 237 provided by a shoulder 238 on the mandrel 210 so that hydraulic fluid can pass only around the periphery of the sleeve during downward movement, however the sleeve can move away from the seat during upward movement. When disengaged from the seat, hydraulic fluid can bypass through recesses 239 internally of the sleeve so that the mandrel 210 can be moved rapidly upwardly to its fully extended position. The ends of the chamber 234 are sealed off by elements 240 and 241 to provide a closed system.

Figure 3:
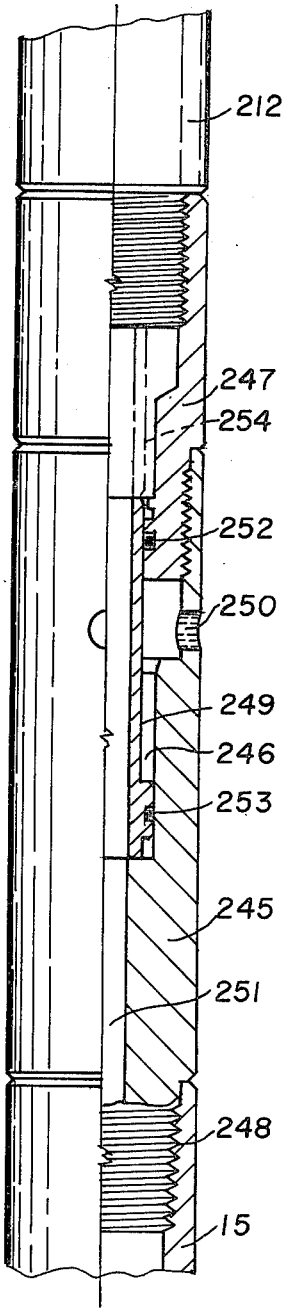
FIG. 3 is a sectional view of the pressure bleed-off valve that operates during expansion of the upper packing element.

As previously mentioned, an overpressure relief valve assembly 14 is connected to the lower end of the tester housing 212 as shown in FIG. 3, and includes a ported sub 245 having a stepped diameter internal bore 246. The upper end of the sub 245 is connected by a coupling to the lower threaded end of the housing 212, and the lower end of the sub is threaded at 248 for connection to the upper end of the pressure recorder carrier 15. A valve sleeve 249 is longitudinally movable within the sub 245 between an upper position where the side ports 250 provide communication between the well annulus and the bore 251 of the sub, and a lower position as shown where seals 252 and 253 are engaged to prevent fluid flow through the ports. The valve sleeve 249 is sized and arranged to be pushed downwardly to the lower position by a lower end extension 254 (FIG. 2B) of the tester mandrel 210 when the said mandrel is disposed in its lowermost position relative to the housing 212, otherwise the valve sleeve is responsive to force due to pressure differences acting across the transverse cross-sectional area bounded by the seal rings 252 and 253. Thus when the valve sleeve 249 is in the lower closed position and the hydrostatic head of the well fluids outside the ports 250 exceeds the pressure of fluids in the bore 251 of the sub 245, a downward force is developed to keep the valve closed. On the other hand if there is a greater pressure of fluids within the bore 251, upward force is developed tending to shift the valve sleeve 249 upwardly to open position.

The valve assembly 14 operates to relieve excess pressures that may be developed in the annular well bore area between the packer elements 20 and 20' as they are inflated. It will be recognized that once the inflatable elements effect a seal with the well bore wall, and since the test valve 13 is not yet open, continued enlargement of the elements by further pumping action will tend to compress the entrapped well fluids therebetween and may raise the fluid pressure in the isolated interval to an excessive value. However, since such pressure acts upwardly on the valve sleeve 243, being communicated to the bore 251 by via the test ports 55 and the various passages 44, 43, 193, 119 and 169, the valve sleeve is forced upwardly to vent fluid to the well annulus above the packer assembly 19 and thereby relieve such excessive pressure. Of course the valve sleeve 246 is forced downwardly to closed position by the end extension 254 of the tester menadrel 210 as the test valve is opened, and will be held in closed position throughout subsequent testing operations by the greater hydrostatic pressure in the well annulus acting through the ports 250 on the transverse pressure area of the valve element.

OPERATION

In operation, the various components of the tool string are in the end-to-end sequence as shown in FIGS. 1A and 1B of the drawings and connected to the drill string 10 preparatory to lowering into the well. The housing 105 of the pump assembly 17 is disposed in its lower position with respect to the mandrel assembly 107, with the clutch nut 123 also in its lower position where its function is to releasably lock the housing and mandrel in a mutually telescoped relationship. This disables the pump assembly 17 until such time as the clutch is released to enable relative longitudinal movement of the housing 105. Of course the inflatable packing elements 20 and 20' are both retracted, and the test valve assembly 13 is closed inasmuch as the mandrel 210 is in an upper or extended position relative to the housing 212, thereby disposing the valve heads 213 and 213' above the flow ports 220 and 218 prohibit fluid flow. As the equipment is lowered into the borehole to setting depth, the drag springs 26 of the drag assembly 25 frictionally engage the walls of the bore to prevent rotation as well as to provide a degree of restraint to vertical motion of the equipment. Such restraint maintains the carrier sleeve 87 in the upper position relative to the body 85 so that the deflate ports 96 are closed and the clutch keys 98 are engaged with the splines 99. The pipe string 10 is either empty of fluids or may be provided with a column of water to act as a cushion as will be apparent to those skilled in the art. In any event, the pipe string 10 provides a low pressure region which can be communicated with an isolated section of the borehole to induce fluids to flow from the formation into the pipe string if they are capable of so doing.

When the tool string is run to the proper depth so that the packing assembly 19 is located adjacent the formation interval to be tested, the interval is isolated by inflating the packing elements 20 and 20' into sealing contact with the surrounding well bore wall in the following manner. First the pipe string 10 is rotated a substantial number of turns to the right. Since the lower packer assembly 20', the deflate valve assembly 24 and the housing 262 of the lower pump 23 can not rotate due to engagement of the drag springs 26 with the well bore wall, the mandrel 260 of the pump is caused to rotate relative to the aforementioned stationary parts. The cam rollers 283, in following the undulating groove 285 of the cam sleeve 280 which is splined for only vertical movement with respect to the housing 262 by the pins 281, drive the cam sleeve vertically upward and downward in a reciprocating motion. Such movement is transmitted by the connector sleeve 288 and the preloaded spring 292 to the piston sleeve 295 which alternately draws in well fluids through the intake passage 303 and the check valves 300 and then exhausts the fluid under pressure via the check valves 301 to the passage 304. The fluid under pressure is directed to the interior of the lower inflatable packer element 61 by the various ports and passages as previously described. When a predetermined inflation pressure has been achieved that has expanded the element 61 into sealing contact with the well bore wall, the preload of the spring 292 is exceeded and the cam and connector sleeves 280 and 288 merely oscillate with respect to the piston sleeve 295 so that no further inflation pressure is supplied. Thus it is not possible with the pump of the present invention to overinflate and possibly injure the packing element 61.

The upper packing assembly 20 now can be inflated to seal off and isolate the test interval as follows. The pipe rotation employed to actuate the lower pump 23 as above-described will have caused the clutch nut 123 to feed upwardly along the pump mandrel section 115 to the upper position where the housing 105 is free to be reciprocated with respect to the mandrel assembly 107. As the housing 105 is elevated, it will be recognized that the weight of all of the equipment therebelow down to the deflate valve assembly 24 will resist upward movement of the mandrel assembly 107, so that pressure is generated within the chamber 131 above the piston 129. Such pressure will cause the check valve sleeve 134 to shift upwardly and uncover the ports 137, so that fluids under pressure are supplied via the inflation passage 118, 194 and 34 into the interior of the packing element 20. The pressure causes the elastomer to inflate and bulge outwardly. When the pump housing 105 reaches the top of its stroke, thus having displaced its working volume of fluid into the inflation passage 118, the pipe string 10 is lowered to recharge the chamber 131 with well fluids. Of course the string of tools now is anchored against downward movement by the inflated lower packer 20'. As the housing 105 moves downwardly a reduction of pressure in the chamber 131 as it enlarges in volume during such downward movement enables the spring 135 to push the valve sleeve 134 downwardly to close off the passages leading to the packing element 20. As the pressure is further reduced by an increase in the working volume 131, the hydrostatic head of the well fluids present above the check valve assembly 132 forces the inlet valve 133 downwardly and away from the seat ring 136, thereby enabling the chamber to fill with well fluids as the housing 105 moves downwardly to the bottom of its stroke. When the chamber 131 is fully expanded, the absence of a pressure differential enables the spring 135 to push the inlet valve 133 closed. A second upward movement of the housing 105 will cause an additional volume of fluid under pressure to be displaced through the various inflation passages and into the packing element 20 to increase its transverse dimension. In typical practice, dependent upon hole size in relation to the relaxed diameter of the packer element 20, a series of only a few cycles of the pump 17 will be sufficient to cause the outer periphery of the element to engage the well bore wall as shown in FIG. 2B. Continued actuation of the pump 17 in response to upward and downward pipe motion will continually increase the inflation pressure until the desired pressure is reached. Immediately after the element actually engages the well wall, the assembly becomes firmly anchored against upward movement due to considerable frictional restraint between the packing element and the surrounding well bore wall.

As previously noted, the difference in seal dimensions between the piston 129 and the mandrel assembly 107 on the one hand, and the seal collar 153 and the tube 112 on the other, are such that a greater volume of well fluid is drawn in through the screen sub 16 than is required for the displacement volume of the pump chamber 131, with the result that during each downward or suction stroke of the housing 105, a certain amount of excess fluid is discharged back to the well annulus via the screen to backflush and purge the openings in the screen element 178. Thus it is practically impossible for the screen to become plugged and result in a misrun.

When a predetermined maximum inflation pressure has been developed within the inflatable element 20 through operation of the pump assembly 17 as described above, the inlet valve seat ring 136 will be forced upwardly and away from the mandrel shoulder 147 on each subsequent upward movement so that all the fluids in the chamber 131 are vented through the screen sub lack to the well annulus, rather than being displaced into the inflation passage 118. Since the amount of force required at the surface to lift the pipe string 10 is directly related to the pressures developed within the chamber 131 and resisting upward movement of the piston 129, the amount of such force will increase until the pressures generated during the upward movements reach a magnitude sufficient to force the seat ring 136 upwardly, after which the force required to lift the pipe 10 during each pumping stroke will remain substantially constant. Thus the weight indicator W at the rig floor can be observed by the tool operator and gives a positive indication of the performance of the downhole tools. That is to say, when the weight value stops increasing during each upward movement of the pipe string, the operator is assured that the packing element 20 is fully expanded to the proper inflation pressure and can discontinue further operation of the pump assembly 17.

It should be noted at this point that upward movement is appropriate to open the pressure equalizing and packer deflating assembly 18, whereas downward movement is used to open the test valve 13. However, the operation of the respective hydraulic delay pistons 195 and 233 of these tools enables the pump assembly 17 to be actuated by repetitive downward and upward movements without opening the test valve or the equalizing valve because such movements occur during substantially lesser time intervals than is required for the delay pistons to meter to a released position. Thus the test and equalizing valves remain closed during operation of the pump assembly 17. Also, as previously mentioned, should an excessive "squeeze" fluid pressure tend to develop within the isolated interval of the well bore between the packing elements 20 and 20' due to expansion of the upper packer subsequent to obtaining effective sealing action against the well bore wall, the excess pressure causes upward movement of the bleed valve element 249 so that the pressure is vented to the well annulus above the upper packing element 20 through the side ports 250. Of course the valve element 249 is shifted back to the lower closed position as the tester valve 13 is opened to initiate the test.

When it is desired to open the tester valve 13, the weight of the pipe string 10 is imposed upon the tools for the length of time necessary to overcome the hydraulic delay section 226. The mandrel 210 moves slowly downwardly during this time interval as the metering piston 233 approaches the enlarged diameter portion 235 of the chamber 234, and then moves rapidly downwardly to its fully contracted position. The valve heads 213 and 213' are thereby positioned below the test ports 220 and 218 to open a flow path through the sample chamber 217 and the mandrel ports 221 into the pipe string 12. Since the pipe string is initially at atmospheric or other low pressure, formation fluids in the isolated well interval between the expanded packing elements 20 and 20' will enter the ports 55 and flow upwardly through the passage 44, the ports 43, the bore 193 of the flow tube 192, through the central opening of the pump mandrel assembly 107, the bore 169 of the screen sub 16, through the pressure recorder carrier 15 and the excess pressure sub 14, and finally through the test valve assembly 13 into the pipe string 12. After a relatively short period of time necessary to drawn down the pressure in the interval of the well bore between the packing elements 20 and 20', the pipe string 10 is raised to shift the tester mandrel 210 upwardly and close the test ports 218 and 220. The formation is thereby shut-in to enable recordal by the gauge in the carrier 15 of pressure built-up data from which various formation and well fluids parameters can be determined as will be appreciated by those skilled in the art. Of course the tester valve can be repeatedly opened and closed as desired to gather further flow and shut-in pressure information, and each time the tester is closed a flowing sample of flowing formation fluids is trapped within the chamber 219. At all times during the test, of course the straddle bypass formed by the lateral ports 47, the bore 46 of the flow tube 45, the ports, the respective bores of the spacer sub 312, the screen tube 308, flow tube 330, ports 75, annular space 77 and the lateral ports 79, remains open to ensure that the hydrostatic pressure of the well fluids above the upper packing element 20 is substantially equalized with the corresponding pressure of well fluids below the lower packing element 20'. The lower pressure recorder in the carrier 103 records the fluid pressure within the isolated interval between the elements 20 and 20' by virtue of being in communication therewith via the lateral ports 100, the bore 99 of the flow tube 78 and the bore of the drag spring tool body 85. The pressure record obtained thereby can, of course, be compared with the readings taken by the upper pressure recorder at 15.

When it is desired to terminate the test, a strain is placed in the pipe string 10, and the tension is maintained for a time sufficient to overcome the retarding action of the hydraulic delay piston 195 in the equalizing and deflate valve assembly 18. As the piston 195 reaches the upper end of the chamber 196, the equalizing grooves 203 and 205 are disposed above the respective seal rings 206 and 204 to communicate both the inflation passage 194 and the test passage 193 with the well annulus above the upper packing element 20 via the ports 201. In this manner, the various pressures are equalized with one another, and the packing element 20 will inherently deflate and retract to its original relaxed dimensions. Upward movement of the tool string will cause extension of the intermediate deflate valve 24 whereby the lower inflation passage at 336 will be communicated with the straddle bypass described above as the packing 332 moves above the ports 328. Such pressure equalization allows the lower packer element 20' to retract to its original relaxed dimensions. As the tools continue to move upwardly, the drag spring tool body 85 will move upward relative to the drag springs 91, thereby exposing the ports 96 above the valve head 93 to open yet another path for equalization of the pressure inside the lower inflatable element 61 with external pressure. The spring carrier 87 will bottom against the flange 102 on the body 85 where the clutch keys 98 are disengaged. Thus the equipment can be withdrawn intact from the well bore where the pressure records and the sample of formation fluids can be analyzed, or for that matter can be moved to another level in the well for additional tests.

Since certain changes or modifications may be made by those skilled in the art without departing from the inventive concepts disclosed herein, it is the aim of the appended claims to cover all such changes and modifications falling within the true spirit and scope of the present invention.

I claim:

1. In a drill stem testing apparatus having upper and lower inflatable packing elements adapted to be suspended in a well bore on a pipe string, the improvement comprising: first pump means operable in response to rotation of the pipe string for inflating said lower packing element into sealing engagement with the well bore wall to seal off the lower end of a well bore interval; and second pump means operable in response to upward and downward movement of the pipe string for inflating said upper packing element into sealing engagement with the well bore wall to seal off the upper end of said well bore interval.

2. The apparatus of claim 1 wherein said first pump means is located between said upper and lower packing elements.

3. The apparatus of claim 2 wherein said first pump means includes a housing fixed to said lower packing means, a mandrel extending into said housing and fixed to said pipe string, and piston and cylinder means actuated by rotation of said mandrel relative to said housing for supplying fluid under pressure to said lower packing element.

4. The apparatus of claim 3 further including drag means frictionally engaging the wall of the well bore and coupled to said housing for preventing rotation thereof in the well bore.

5. The apparatus of claim 4 further including normally closed deflate valve means for enabling deflation and retraction of said lower packing element upon termination of a drill stem test.

6. The apparatus of claim 5 wherein said deflate valve means includes an upper deflate valve assembly located above said lower packer element and a lower deflate valve assembly located below said lower packer element, said assemblies cooperating with said drag means and being operably responsive to longitudinal movement of said pipe string.

7. The apparatus of claim 1 wherein said second pump means is located above said upper packing element.

8. The apparatus of claim 7 wherein said second pump means includes a mandrel fixed to said upper packing means, a housing telescoped over said mandrel and fixed to said pipe string, and piston and cylinder means actuated by longitudinal of said housing relative to said mandrel for supplying fluid under pressure to said upper packing element.

9. The apparatus of claim 8 further including normally closed deflate valve means for enabling deflation and retraction of said upper packing element upon termination of a drill stem test.

10. The apparatus of claim 1 further including fluid passage means for communicating a region of the well bore above said upper packing element with a region of the well bore below said lower packing element at all times during a drill stem test.

11. The apparatus of claim 1 further including fluid passage means for communicating the interval of the well bore between said upper and lower packing elements with a region of the well bore above said upper packing element during inflation of said upper packing element by said second pump means and valve means for closing off said fluid passage means after said upper packing element has been fully inflated.

12. The apparatus of claim 1 further including test valve means responsive to manipulation of said pipe string for opening and closing a fluid flow path leading from said well bore interval to the interior of said pipe string.

13. The apparatus of claim 12 further including means for recording the pressure of fluids in said flow path below said test valve means while said test valve means is open and while said test valve means is closed.

14. Apparatus for use in inflating an inflatable packing element adapted to expand into sealing engagement with a surrounding well bore wall, comprising: housing means adapted to be restrained against rotation in the well bore; a mandrel adapted to be rotated relative to said housing; annular piston and cylinder means in said housing, said piston means being arranged for reciprocating movement with respect to said cylinder means for supplying fluid under pressure to said packing element; means for converting rotary movement of said mandrel to reciprocating movement of said piston means; and yieldable means operable only after a predetermined inflation pressure has been developed for disabling said converting means for automatically stopping the supply of fluid to said packing element during continued rotation of said mandrel to limit the inflation pressure applied to said packing element.

15. The apparatus of claim 14 wherein said converting means includes cam and follower means, one of said cam and follower means being coupled to said piston means by relatively movable parts, said yieldable means including preloaded spring means reacting between said parts with a selected pressure for transmitting motion therethrough until the inflation pressure developed by said piston means exceeds said selected pressure.

16. The apparatus of claim 14 wherein said converting means includes cam and follower means, one of said cam and follower means being coupled to said piston means by a lost-motion linkage including telescoping sleeves having opposed shoulder surfaces, said yieldable means comprising a partially compressed spring reacting between said shoulder surfaces for opposing telescoping movement of said sleeves with a selected pressure, said sleeves and spring transmitting the motion of said one means to said piston means until an inflation pressure is developed in said cylinder means that is at least equal to said selected pressure, after which said sleeves can telescope relative to one another due to compression of said spring to limit the magnitude of inflation pressure applied to said packing element.

17. The apparatus of claim 14 wherein said annular cylinder means is formed between an inner wall surface of said housing and an outer wall surface of a sleeve member that has its lower end attached to said housing and forming an integral part thereof.

18. The apparatus of claim 17 wherein said mandrel includes a portion that extends into an annular clearance space provided between said housing and the upper end portion of said sleeve member, said mandrel being sealed with respect to said upper end portion and said housing.

19. The apparatus of claim 18 further including sleeve piston means movably mounted on said mandrel portion and defining therewith a variable capacity chamber, and means for communicating said chamber with the interior of said mandrel to enable fluid pressure equalization between said interior and said annular clearance space.

20. The apparatus of claim 14 further including screen means mounted within said housing for substantially preventing solid particles that may be suspended in the well fluids from entering the intake to said cylinder means.

* * * * *